US006476564B1

(12) United States Patent
Tsuchida

(10) Patent No.: US 6,476,564 B1
(45) Date of Patent: Nov. 5, 2002

(54) FLASH LIGHT EMITTING DEVICE

(75) Inventor: Keiichi Tsuchida, Fuchu (JP)

(73) Assignee: Olympus Optical Co., Ltd., Tokyo (JP)

( * ) Notice: Subject to any disclaimer, the term of this patent is extended or adjusted under 35 U.S.C. 154(b) by 5 days.

(21) Appl. No.: 09/603,392

(22) Filed: Jun. 23, 2000

(30) Foreign Application Priority Data

Jun. 28, 1999 (JP) ..... 11-182331

(51) Int. Cl.[7] ..... H05B 41/00

(52) U.S. Cl. ..... 315/241 P; 315/241 S; 315/360; 396/205

(58) Field of Search ..... 315/241 P, 241 R, 315/307, 241 S; 396/205, 206; 323/166

(56) References Cited

U.S. PATENT DOCUMENTS 4,422,016 A * 12/1983 Kurple ..... 315/241 S
4,989,029 A * 1/1991 Inoue et al. ..... 396/203
5,016,038 A * 5/1991 Kobayashi et al. ..... 396/206
5,221,942 A * 6/1993 Ogawa ..... 315/241 P
5,895,983 A * 4/1999 Motomura ..... 307/106
6,288,890 B1 * 9/2001 Saito et al. ..... 361/523

* cited by examiner

*Primary Examiner*—Haissa Philogene
*Assistant Examiner*—Ephrem Alemu
(74) *Attorney, Agent, or Firm*—Frishauf, Holtz, Goodman & Chick, P.C.

(57) ABSTRACT

The flash light emitting device includes a charging circuit for charging the light emitting energy into a capacitor by boosting a power supply voltage, and a light emitting circuit for making a flash light emitting tube emit light with the use of the energy of the capacitor. The flash light emitting device further includes a timer which counts a lapsed time from a point of time that a given amount of charging to the capacitor performed by the charging circuit is completed, and a charging controller which controls whether a next charging operation by the charging circuit is to be started or not based on the lapsed time counted by the timer.

14 Claims, 10 Drawing Sheets

FLASH LIGHT EMITTING DEVICE

This application claims benefit of Japanese Patent Application No. H11-182331 filed in Japan on Jun. 28, 1999, the contents of which are incorporated by this reference.

BACKGROUND OF THE INVENTION

1. Field of the Invention

This invention relates to a flash light emitting device, and more particularly to a flash light emitting device equipped with a charge device.

2. Related Art Statement

Conventionally, in the field of flash light emitting devices used for photographing with cameras or the like, to measure a charge voltage of a capacitor which stores the light emitting energy, a method in which a plurality of resistors are provided at both ends of the capacitor and the voltage of the capacitor is measured based on voltages generated to division resistors at the time of operating a charge circuit has been proposed.

Further, an aluminum electrolytic capacitor is used as the capacitor which stores the energy.

In such flash light emitting devices, however, at the time of measuring the charge voltage, the charging of short time inevitably becomes necessary before the measurement of the capacitor voltage. In case the turning on and off of a photographing preparation switch (a first release of the release of the camera) is repeated due to such a measurement mode, the measurement of the charge voltage of the capacitor is performed each time the switch is turned on and hence, the voltage of the capacitor is increased and exceeds a given charge voltage. Accordingly, a drawback that an amount of light which exceeds a given amount of light is generated at the time of strobe light emission or the charge voltage is increased and exceeds the withstand voltage of the capacitor may arise.

Further, the aluminum electrolytic capacitor which is used as the charging capacitor is liable to increase the leakage of the charge when the voltage is increased or the temperature is elevated.

FIG. 10 shows an equivalent circuit of a typical aluminum electrolytic capacitor. According to this equivalent circuit shown in FIG. 10, a variable resistor which varies its resistance due to voltage and temperature is connected to both ends of the capacitor. In such a charge storing capacitor, the charge leaks during charging and hence, unless the charge which exceeds the necessary charge amount is supplied to the capacitor, there arises a problem that the voltage of the capacitor does not reach the full charge voltage.

Here, the difference between the aluminum electrolytic capacitor and a film capacitor is explained.

In the aluminum electrolytic capacitor, a dielectric is made of aluminum oxide ($Al_2O_3$), while in the film capacitor, a dielectric is made of polyester, polypropylene or the like.

To be more specific, in the aluminum electrolytic capacitor, the dielectric is formed such that an aluminum foil which is subjected to an etching treatment is continuously electrochemically treated in a liquid made of ammonium pentaborate or the like at a voltage (formation voltage) which is 120–200% of the rated voltage. The advantage of the aluminum electrolytic capacitor lies in the low cost, the compactness and the large capacity.

The film capacitor is constituted as follows. That is, a film which deposits aluminum onto a polyester (PET), polypropylene (OPP) or polyphenylene sulfide (PPS) film by a vacuum deposition is used as the dielectric. The film is wound while assuring the insulation between film and aluminum. Metallikons are provided to both ends of the film to form the non-inductive structure. Lead wires are welded to the metallikon portions and an outer casing is provided around the wound film. The advantage of the film capacitor lies in the excellent characteristics, the extent that the capacitor can be manufactured from low voltage to high voltage and the high reliability.

FIG. 11 is a diagram which shows the consumed current amount of a boosting circuit necessary for boosting a unit voltage of a typical aluminum electrolytic capacitor and a film capacitor. As shown in FIG. 11, it is understood that corresponding to the increase of voltage, the necessary charge amount of the aluminum electrolytic capacitor is increased.

FIG. 12 is a diagram showing the lapse of time of holding voltage of a typical aluminum electrolytic capacitor and a film capacitor. As shown in FIG. 12, it is understood that when the voltage is high, the lowering of voltage of the aluminum electrolytic capacitor is sharp and hence, the charge which has been stored is lost wastefully. Accordingly, a problem that the aluminum electrolytic capacitor must be recharged right before charging arises.

OBJECTS AND SUMMARY OF THE INVENTION

It is the first object of the present invention to provide a flash light emitting device which can properly perform a charge control of a main capacitor and prevent a wasteful consumption of the energy.

It is the second object of the present invention to provide a flash light emitting device which can prevent the charge voltage of the capacitor from exceeding the full charge voltage even when the turning on and off of a photographing preparation switch is repeated many times and obviates the consumption of the wasteful energy.

To summarize the present invention, in the flash light emitting device which includes a charging circuit for charging the light emitting energy into a capacitor by boosting a power supply voltage and a light emitting circuit for making a flash light emitting tube emit light with the use of the energy of the capacitor, the flash light emitting device further includes timer means which counts a lapsed time from a point of time that a given amount of charging to the capacitor performed by the charging circuit is completed and charging control means which controls whether a next charging operation by the charging circuit is to be star ted or not based on the lapsed time counted by the timer means.

These objects and advantages of the present invention will become further t from the following detailed explanation.

DETAILED DESCRIPTION OF THE PREFERRED EMBODIMENTS

Embodiments of the present invention are explained hereinafter in conjunction with attached drawings.

Figure 1:
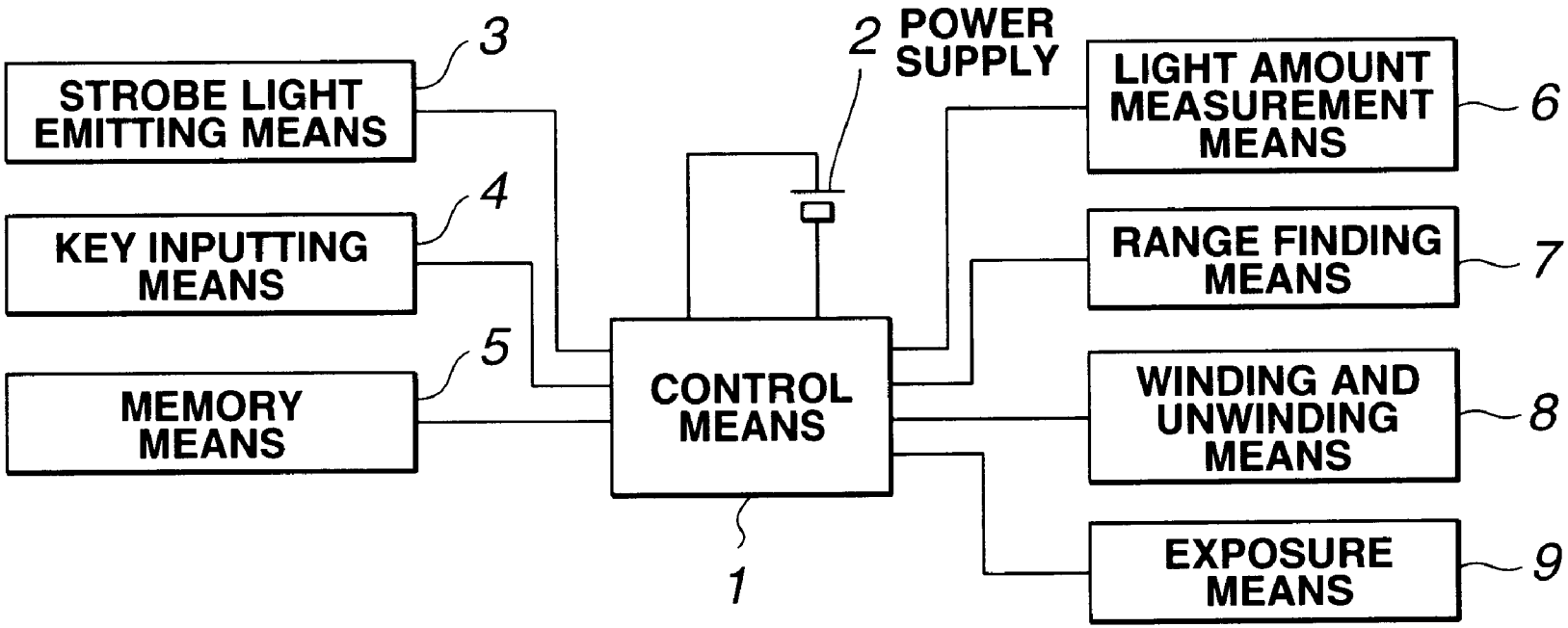
FIG. 1 is a block diagram showing the constitution of a main part of a camera according to one embodiment of the present invention.

FIG. 1 is a block diagram showing the constitution of a main part of a camera according to one embodiment of the present invention.

As shown in FIG. 1, the main part of the camera of this embodiment is constituted by control means 1 made of a CPU which controls the whole camera, a power supply 2 which supplies electric power to the whole camera including the control means 1, strobe light emitting means 3 which emits a strobe light, KEY inputting means 4 which controls a release switch and various mode switches, memory means 5 which is made of an EEPROM, for example, and stores the various conditions of the camera, the number of photographing and the like, light amount measuring means 6 which measures the light amount of an object, range finding means 7 which measures the distance to the object, winding and unwinding means 8 which performs the winding and the unwinding of a film, and exposure means 9 which performs the control of the shutter.

The strobe light emitting means 3 works as a charging circuit for charging the light emitting energy to the capacitor by boosting the power supply voltage and a light emitting circuit which makes a flash light emitting tube (a xenon tube 111) emit light with the use of the energy of a main capacitor (a film capacitor 108) which will be explained later.

Further, the control means 1 works as timer means which counts time from a point of time that the charging by the above-mentioned charging circuit (strobe light emitting means 3) is completed, counted time judging means which compares time counted by the timer means with a given time, and charging control means which performs a judgement control whether a next recharging operation start by the charging circuit should be allowed or not based on the result of the counted time judging means. The detail of the control means 1 is explained later in detail.

In the camera having the above-mentioned constitution, when a switch R1 (not shown in the drawing) which shifts the operation to a photographing preparation condition by the manipulation of the KEY inputting means 4, the control means 1 measures the luminance of an object by operating the light amount measuring means 6. Further, the control means 1 measures the distance between the camera and the object by operating the range finding means 7. Thereafter, when a switch R2 (not shown in the drawing) which shifts the operation to the photographing condition is pushed, the control means 1 operates a shutter of the exposure means 9. Accordingly, a film is exposed and the photographing is performed.

In this photographing, when the light amount measured by the light amount measuring means 6 is small, the control means 1 operates the strobe light emitting means 3 so as to make the strobe light emitting means 3 emit light to the object and the photographing is performed. Further, the control means 1 operates the winding and unwinding circuit 8 to wind one frame when the shutter is closed and operates the charging circuit of the strobe light emitting means 3 so as to complete the preparation for light emission when the strobe emits light.

Figure 2:
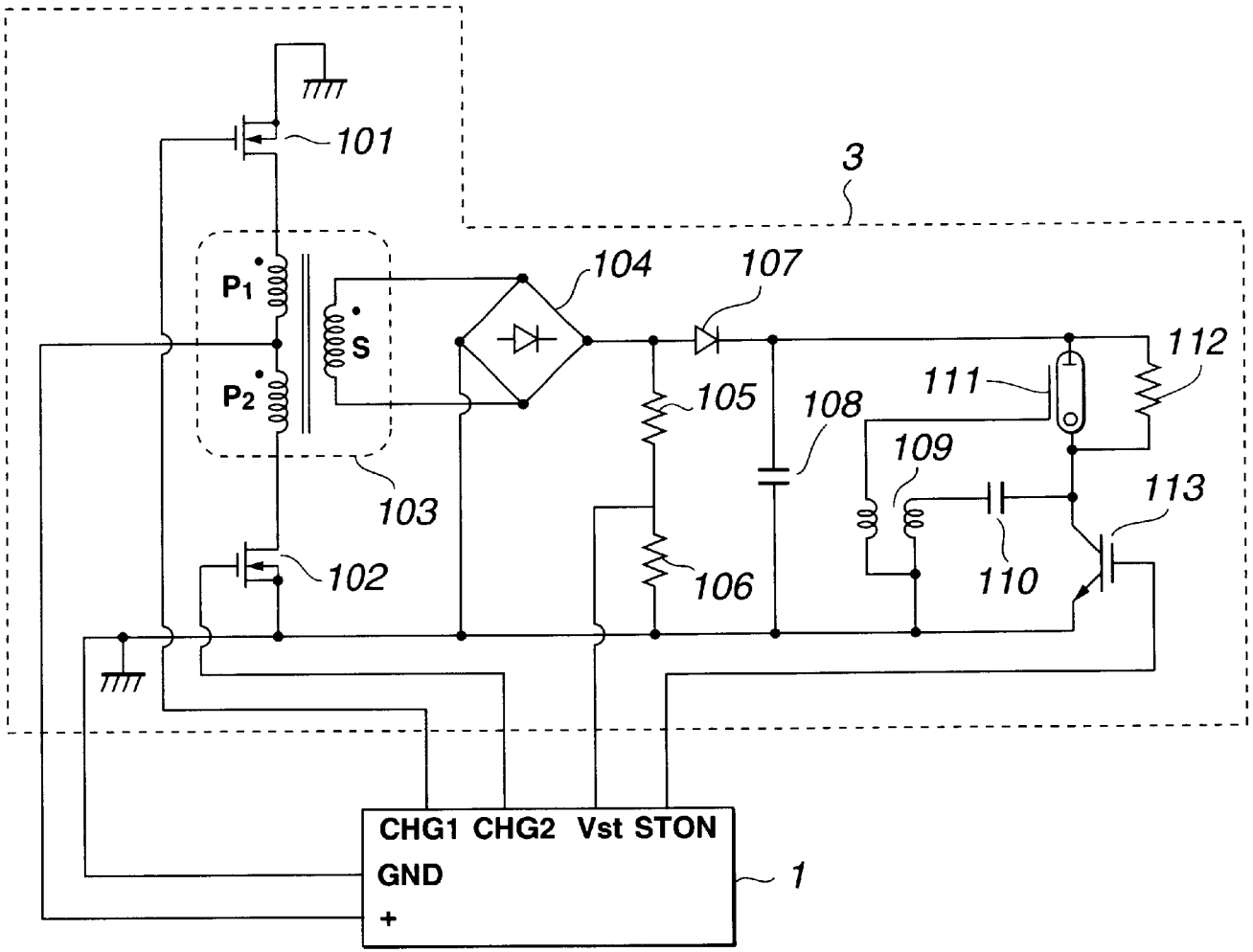
FIG. 2 is a circuit diagram of an electric circuit of strobe light emitting means in the camera according to the above-mentioned embodiment.

FIG. 2 is an electric circuit diagram showing the circuit constitution of the above-mentioned strobe light emitting means 3 according to the first embodiment.

As shown in FIG. 2, power supply terminals of the strobe light emitting means 3 are connected to a + terminal and a GND terminal of the control circuit 1 to receive the supply of power.

A transformer 103 is constituted by primary windings P1, P2 and a secondary winding S and an intermediate terminal between the primary winding P1, P2 is connected to the + terminal of the power supply (control means 1).

A winding start portion of the primary winding P1 of the transformer 103 is connected to a drain terminal of a MOS-FET 101. Further, the MOS-FET 101 has a source terminal and a gate terminal thereof respectively connected to the GND terminal of the control means 1 and an output terminal CHG1 of the control means 1.

Further, a winding finish point of the primary winding P2 of the transformer 103 is connected to a drain terminal of a MOS-FET 102. Further, the MOS-FET 102 has a source terminal and a gate terminal thereof respectively connected to the GND terminal of the control means 1 and an output terminal CHG2 of the control means 1.

Still further, the secondary wiring S of the transformer 103 is connected to a bridge diode 104 as shown in the drawing. An output terminal of the bridge diode 104 is connected to a series circuit constituted by resistors 105, 106 and an anode of a diode 107.

Further, a middle point disposed between the resistors 105, 106 is connected to a Vst terminal of the control circuit 1.

A cathode of t e diode 107 is connected to a film capacitor 108 which generates a little leakage current and exhibits improved holding voltage characteristics. A series circuit constituted by a xenon tube 111 and an IGBT 113, a resistor 112, a capacitor 110 and a primary side series circuit of a trigger coil 109 are connect ed in parallel with the film capacitor 108.

Further, as shown in the drawing, a cathode of the xenon tube 111 and the resistor 112 are connected in parallel. One end of a secondary winding of the trigger coil 109 is connected to the outer periphery of the xenon tube 111 while the other end of the secondary winding of the trigger coil 109 is connected to the GND. A gate terminal of the IGBT 113 is connected to the STON terminal of the control circuit 1.

The manner of operation of the strobe light emitting means 3 which is constituted by the above-mentioned connections is explained hereinafter in conjunction with FIG. 2 and FIG. 3.

Figure 3:
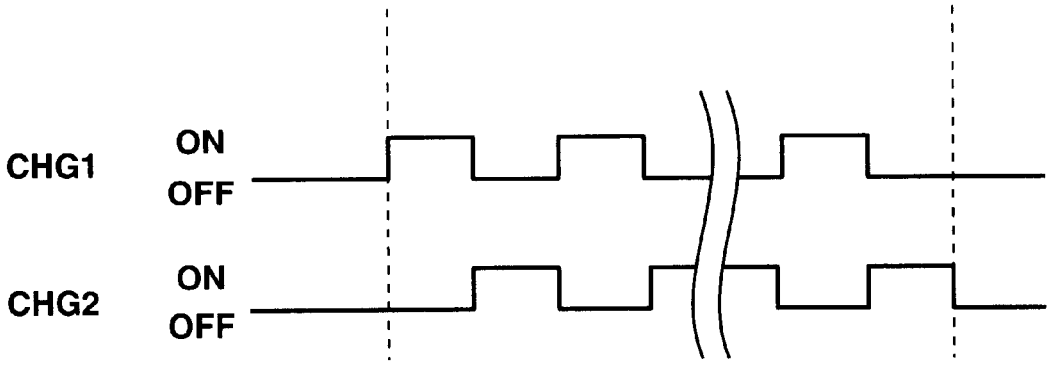
FIG. 3 is a timing chart which indicates output signals from output terminals CHG1, CHG2 of control means of the camera according to the above-mentioned embodiment.

FIG. 3 is a timing chart which shows output signals of the output terminals CHG1, CHG2 of the control means 1 in the camera according to this embodiment.

Charge signals are outputted from the output terminals CHG1, CHG2 of the control means 1. These output signals are outputted in such a manner that CHG1, CHG2 alternately repeat turning on and off thereof as shown in the timing chart of FIG. 3.

When the ON signal (H) is outputted from the output terminals CHG1 of the control means 1, the MOS-FET 101 is turned on and the current flows through the power supply+→the primary winding P1 of the transformer 103→the MOS-FET 101→the GND. When the current flows in the primary winding P1 of the transformer 103, an electromotive force is generated in the secondary winding S of the transformer 103. The current produced by this electromotive force flows in the film capacitor 108 through a voltage detection circuit which is formed by the series circuit made of the resistors 105, 106 and the diode 107 by way of the bridge diode 104 and the charge is stored in the film capacitor 108.

The ON time of the MOS-FET 101 is set to the time in which the secondary winding S of the transformer 103 discharges the electromotive force. When the ON time of the MOS-FET 101 ends, the MOS-FET 101 is turned off. Simultaneous with such operation, the control means 1 outputs the ON signal (H) from the CHG2.

When the ON signal (H) is outputted from the output terminal CHG2 of the control means 1, the MOS-FET 102 is turned on and the current flows through the power supply+→the primary winding P2 of the transformer 103→the MOS-FET 102 the GND. Then, as in the case of the previously mentioned primary winding P1, the charge is stored in the film capacitor 108. In this manner, by alternately driving the output terminals CHG1 and CHG2 of the control means 1, the light emitting energy is stored in the film capacitor 108.

The series resistance made of the above-mentioned resistors 105, 106 constitutes the voltage detection circuit which detects the charge voltage of the film capacitor 108. During the operation of the charging circuit, the voltage of [1/resistance ratio] of the charge voltage is applied from the middle point disposed between two resistors 105, 106 to the input terminal Vst of the control circuit 1 and the present charge voltage value is converted to numerical values by an A/D circuit of the control circuit 1. Since the A/D value at the full charge voltage is stored in the memory means 5 as shown in FIG. 1, the present capacitor voltage can be understood by the A/D value.

The diode 107 is a diode which prevents the backflow of the capacitor and prevents the current from flowing into the voltage detection circuit after stopping charging.

The energy stored in the film capacitor 108 is converted into light by means of the light emitting circuit constituted by the trigger coil 109, the trigger capacitor 110, the xenon tube 111, the resistor 112 and the IGBT 113 which performs the control of emitting light amount and the light is irradiated to the object. The same voltage as applied to the film capacitor 108 is applied to the trigger capacitor 110 through the resistor 112.

When the light emitting signal is outputted from the STON terminal of the control circuit 1, the IGBT 113 is turned on and the charge stored in the trigger capacitor 110 flows through the trigger capacitor 11→the IGBT 113→the primary side of the trigger coil 109→the trigger capacitor 110.

When the current flows in the primary side of the trigger coil 109, the same energy is generated at the secondary side of the trigger coil 109. The generated energy is applied to a glass portion of the xenon tube 111 so as to excite (reduce the resistance value of) a xenon gas in the tube. When the xenon gas is excited, the charge stored in the film capacitor 108 flows through the film capacitor 108→the xenon tube 111→the IGBT 113→the film capacitor 108 and the xenon tube 111 emits light.

When the ON time of the STON terminal reaches the ON time preset by the control circuit 1, the OFF signal is outputted from the STON terminal. Upon outputting of the OFF signal, the IGBT 113 is turned off to stop the flow of current so that the light emitting ends.

Figure 4:
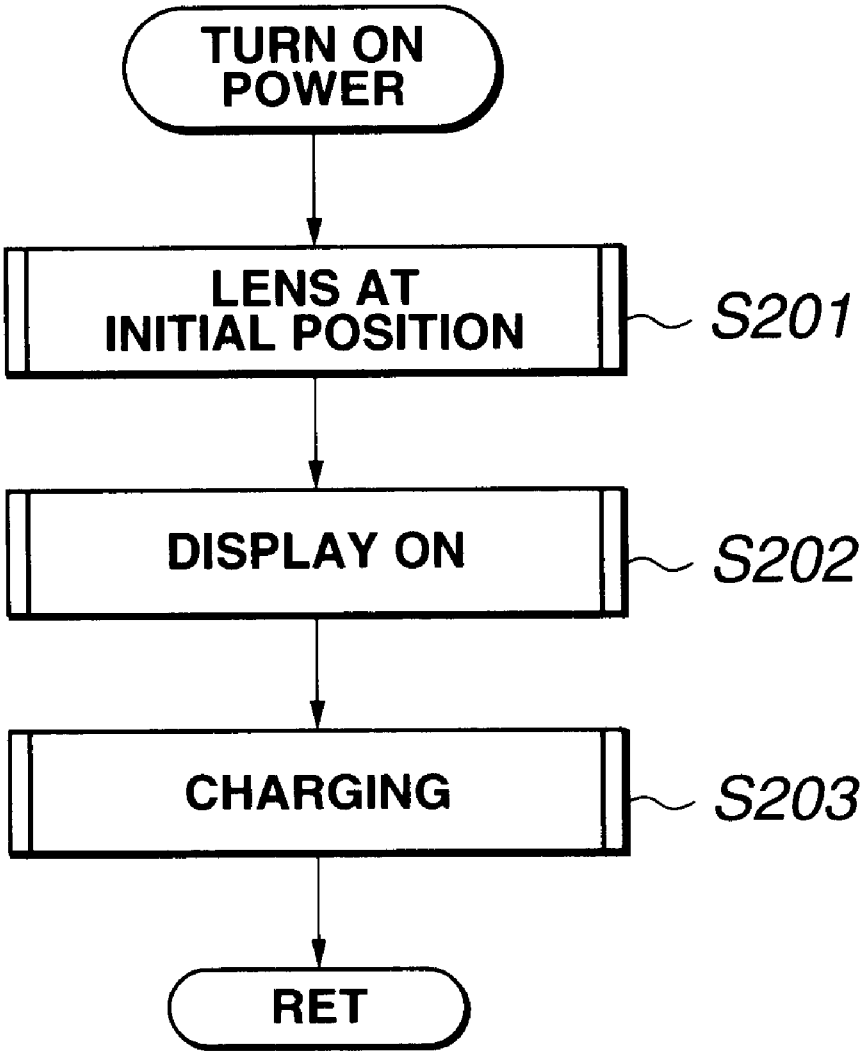
FIG. 4 is a flowchart showing the operation of the camera after turning on a main switch in the camera according to the above-mentioned embodiment.

Subsequently, the manner of operation of the camera of this embodiment performed when the main switch of the camera is turned on with the manipulation of the above-mentioned KEY inputting means 4 is explained hereinafter in conjunction with FIG. 4.

First of all, ia step S201,when the main switch is turned on, the control means 1 performs the photographing preparation by moving a lens to a photographing position. Subsequently, in the step S202, the number of photographing and the date of photographing are displayed. Then, in a step S203, a sub routine of the strobe charging is performed so as to complete the photographing preparation.

Figure 5:
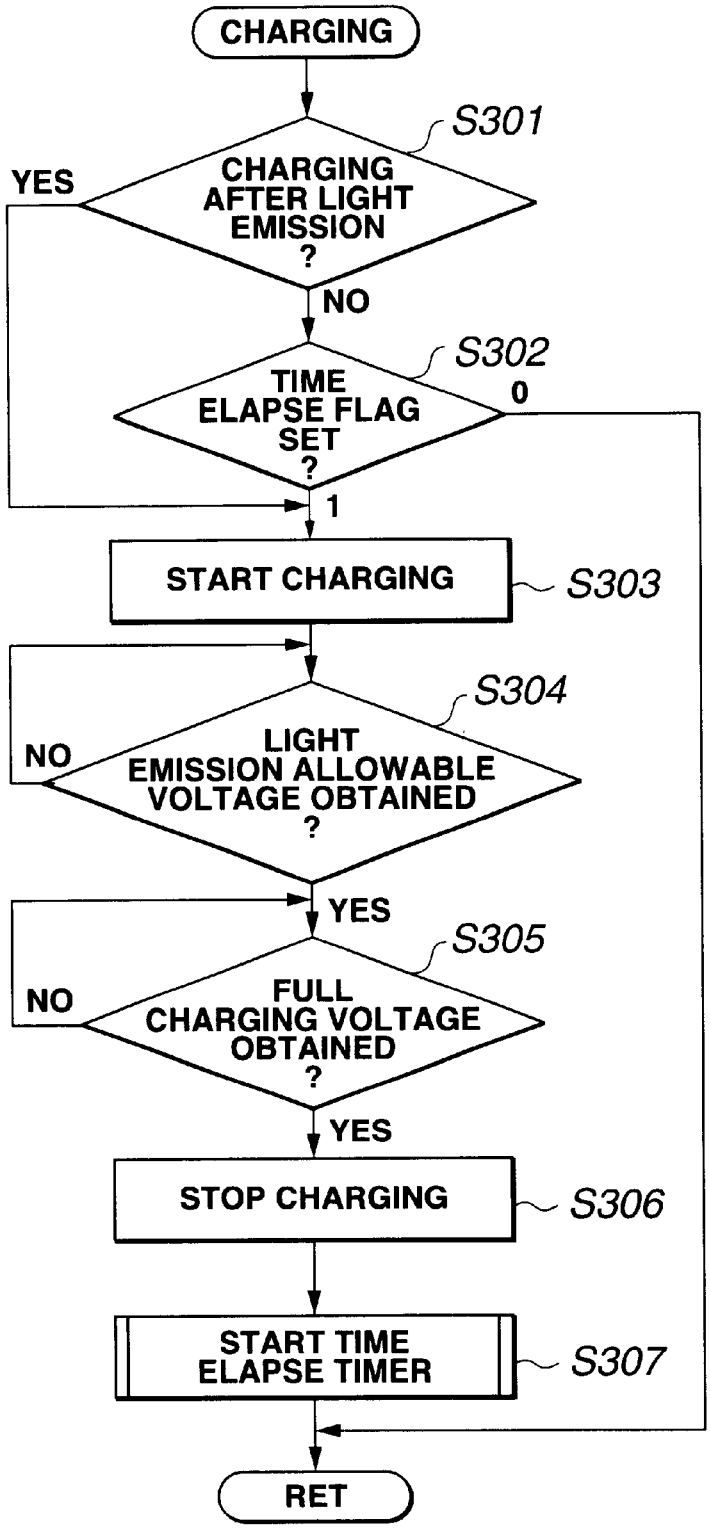
FIG. 5 is a flow chart showing a subroutine of a strobe charging in the camera according to the above-mentioned embodiment.

Here, the subroutine of the strobe charging in the camera of this invention is explained in conjunction with FIG. 5.

FIG. 5 is a flow chart which shows the subroutine of the strobe charging in the camera of this embodiment.

First of all, in a step S301, the control means 1 checks whether the time for charging is after the strobe light emission or not. If the charging is a charging after the light emission, the control means 1 advances to a step S303 and if the charging is a charging other than the charging after the light emission, the control means 1 advances to a step S302.

In the step S302, the control means 1 performs checking of a time lapse flag . When a given time has passed since the preceding charging, the time lapse flag is "1", while when the given time has not yet passed since the preceding charging, the time lapse flag is "0".

In the step S302, when the given time has passed, the control means 1 advances to the step S303 and when the given time has not yet passed, the control means 1 returns as it is and ends the subroutine.

In the step S303, the control means 1 outputs the charging start signal to the strobe light emitting means 3.

Subsequently, by means of the voltage detection circuit which is constituted the series circuit made of the resistors 105, 106 by way of the bridge diode 104 in the electric circuit diagram shown in FIG. 2, the measurement of the charge voltage of the film capacitor 108 is started. In steps S304 and S305, the measured charge voltage value of the film capacitor 108 is compared with given reference judgement voltages respectively.

Subsequently, in the step 304 the control means 1 waits until the charge voltage reaches the light emission allowable voltage. Here, once the charge voltage reaches the light emission allowable voltage, the control means 1 advances to the step S305.

Then, in the step S305, the control means 1 waits until the charge voltage reaches the full charge voltage and once the charge voltage reaches the full charge voltage, the control means 1 advances to a step S306. That is, the control means 1 executes the subroutine in which when the charge voltage reaches the full charge voltage, the control means 1 stops the charging operation in the step S306 and then starts a timer which counts time from the completion of charging in the step S307.

Here, the timer sets the time during which the voltage of the film capacitor 108 (see FIG. 2) in the strobe light emitting means 3 is reduced from the full charge voltage to the minimum voltage which allows light emission. The subroutine is explained hereinafter in conjunction with FIG. 6.

Figure 6:
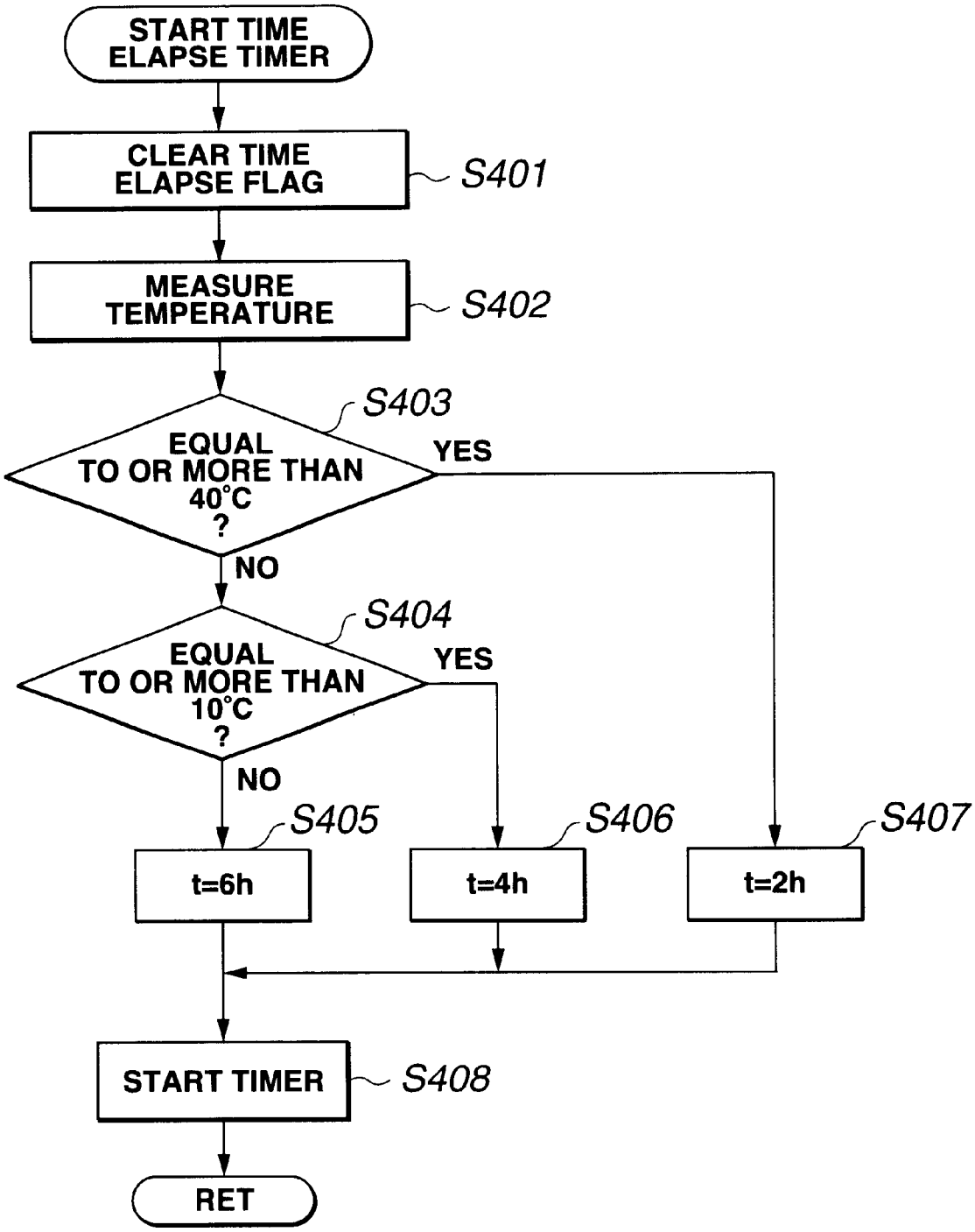
FIG. 6 is a flow chart showing a subroutine of a time lapse timer start in the camera according to the above-mentioned embodiment.

FIG. 6 is a flow chart showing the subroutine of the time lapse timer start in the camera of this embodiment.

When the control means 1 enters the time lapse setting subroutine, first of all, the control means 1 clears the time lapse flag in the step S401. Subsequently, in the step S402, the control means 1 measures the temperature of the inside of the camera. This operation is performed due to a following reason. That is, the holding voltage of the film capacitor 108 varies corresponding to the temperature of the capacitor and hence, the time setting corresponding to the temperature becomes necessary.

Subsequently, in case the temperature measured in the above-mentioned step S402 is equal to or above 40° C., (step S403), the control means 1 advances to a step S407 and sets the time lapse timer to 2 hours and advances to a step S408.

Further, in case the temperature measured in the above-mentioned step S402 is equal to or below 40° C. (step S403), the control means 1 advances to the step S404 an d performs the judgement with respect to the set temperature of low value. That is, in case the measured temperature is equal to or above 10° C., the control means 1 advances to a step S406 and sets the set time to 4 hours and in case the measured temperature is equal to or below 10° C., the control means 1 advances to a step S405 and sets the set time to 6 hours.

After completing the above-mentioned setting of time, the control means 1 starts the timer in the step S408 as next processing and ends the subroutine. The timer is a timer independently built in the inside of the control means 1 and is designed such that the time lapse flag is set when the time becomes the set time in this subroutine.

Subsequently, the subroutine which is executed in case the switch 1R which moves the camera operation to the photographing preparation condition is pushed by the manipulation of the KEY inputting means 4 is explained in conjunction with FIG. 7.

Figure 7:
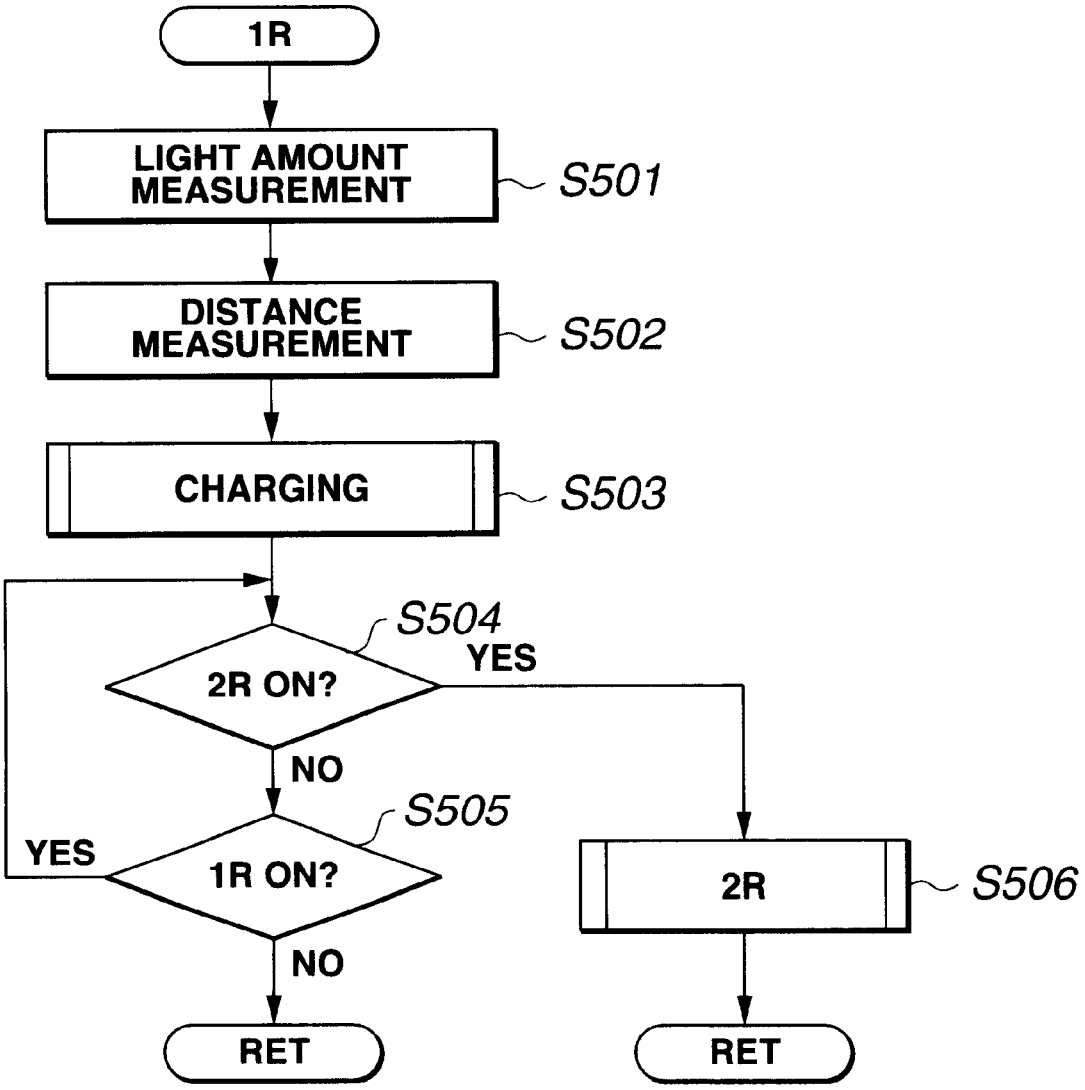
FIG. 7 is a flow chart showing a subroutine ⌈1R⌋ in the camera according to the above-mentioned embodiment.

FIG. 7 is a flow chart which shows the subroutine ⌈1R⌋ executed when the switch 1R which moves the camera operation to the photographing preparation condition in the camera of this embodiment is pushed.

In executing the subroutine ⌈1R⌋ first of all, the control means 1 measures the present light amount of the object by the above-mentioned light amount measuring means 6 (see FIG. 1) in a step S501. Subsequently, the control means 1 measures the distance from the camera to the object by the above-mentioned rang e finding means 7 in a step S502. Further, in a step S503, the control means 1 executes the charging subroutine similar to the subroutine the step S203 of FIG. 4.

In executing the subroutine, ⌈1R⌋ the charging of the capacitor is performed in the power-on subroutine right after a power switch (main switch) is turned on. Here, the time lapse flag is not set. However, in case a given long time passes after the power is turned on and the time lapse flag is set, the charging is performed in the charging subroutine shown in FIG. 5 until the voltage of the capacitor reaches the full charge state.

Thereafter, in a step S504, the control means 1 checks the condition of the photographing switch 2R (not shown in the drawing) in the above-mentioned KEY inputting means 4. If the photographing switch 2R is turned on, the control means 1 advances to a step 506 while if the photographing switch 2R is not turned on, the control means 1 advances to a step 505.

In this step S506, the control means 1 executes the subroutine 2R and then returns to the initial condition. Further, in the step S505, the control means 1 checks whether the switch 1R which moves the camera operation to the photographing preparation condition cis turned on or not. If the switch 1R is turned on, the control means 1 returns to the step S504, while if the switch 1R is turned off, the control means 1 returns to the initial condition.

Figure 8:
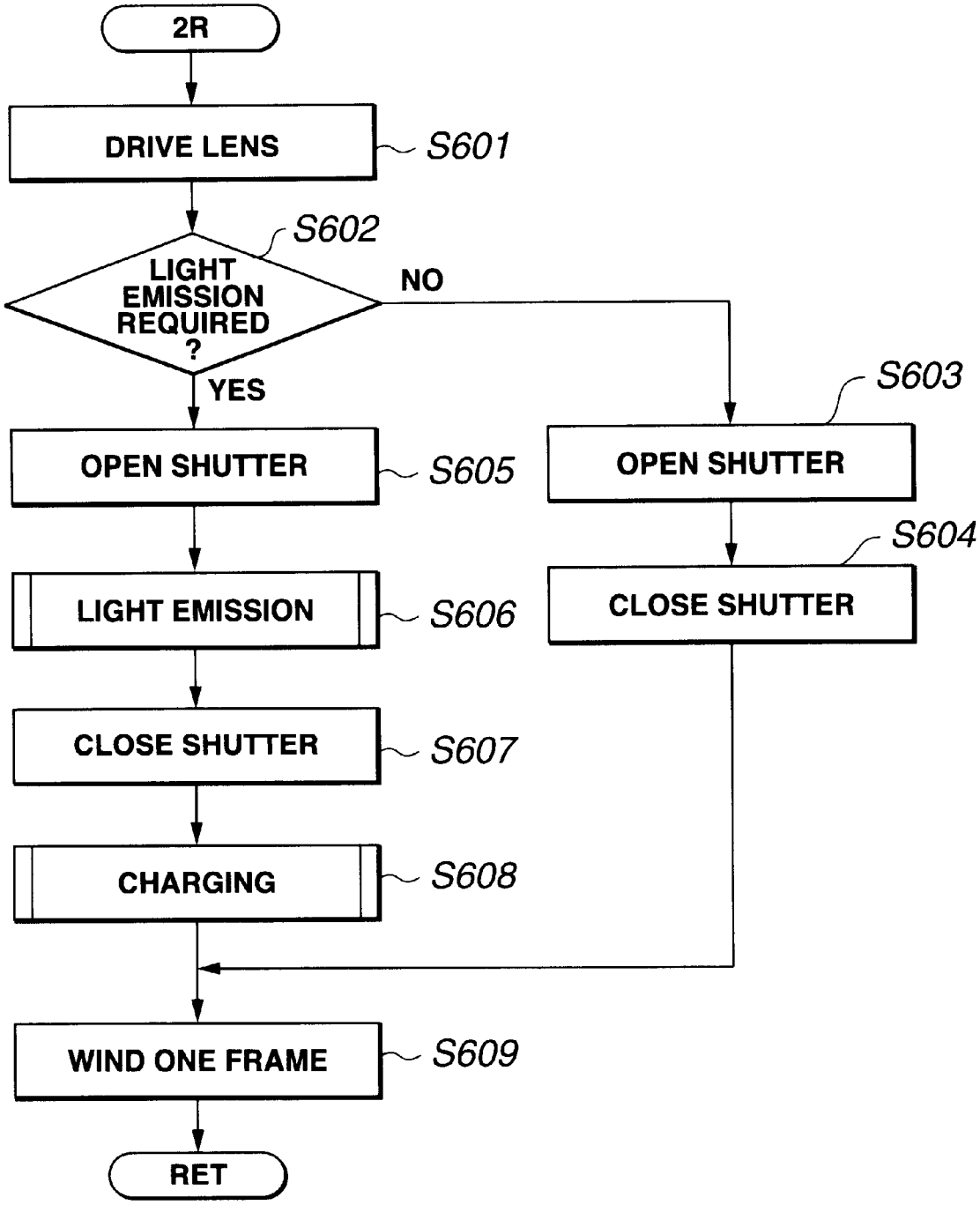
FIG. 8 is a flow chart showing a subroutine ⌈2R⌋ in the camera according to the above-mentioned embodiment.

Here, the case in which the photographing switch 2R is turned on is explained in conjunction with FIG. 8. FIG. 8 is a flow chart which shows the subroutine ⌈2R⌋ when the photographing switch 2R in the camera of this embodiment is pushed.

When this subroutine ⌈2R⌋ is executed, in a step S601, the control means 1 moves a photographing lens not shown in the drawing based on data which is obtained by performing distance measurement in the above-mentioned subroutine ⌈1R⌋. In a succeeding step S602, the control means 1 performs the judgement on the strobe light emission based on the result of light amount measurement. Here, if it is judged that the light emission is not necessary, the control means 1 advances to a step S603 and opens the shutter so as to perform the exposure of the film. Then, in a step S604, when the exposure is completed, the control means 1 closes the shutter so as to end the exposure.

On the other hand, if the light emission is demanded in the step S602, the control means 1 advances to a step S605 and opens the shutter. When the shutter is completely opened in the step S606, the control means 1 executes the subroutine for performing the strobe light emission.

Figure 9:
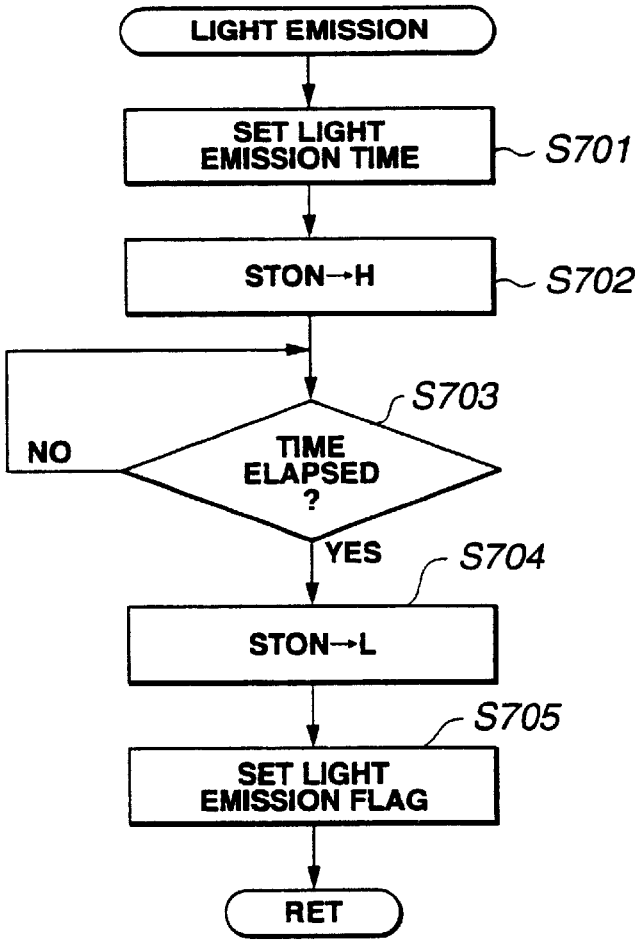
FIG. 9 is a flowchart showing a light emission subroutine in the camera according to the above-mentioned embodiment.
Figure 10:
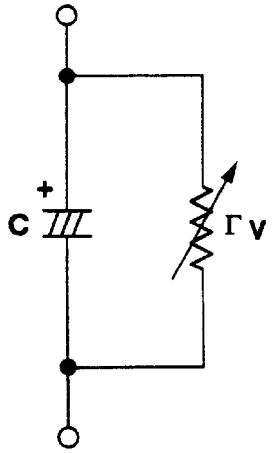
FIG.10 PRIOR ART
FIG. 10 is a view showing an equivalent circuit of a typical aluminum electrolytic capacitor.
Figure 11:
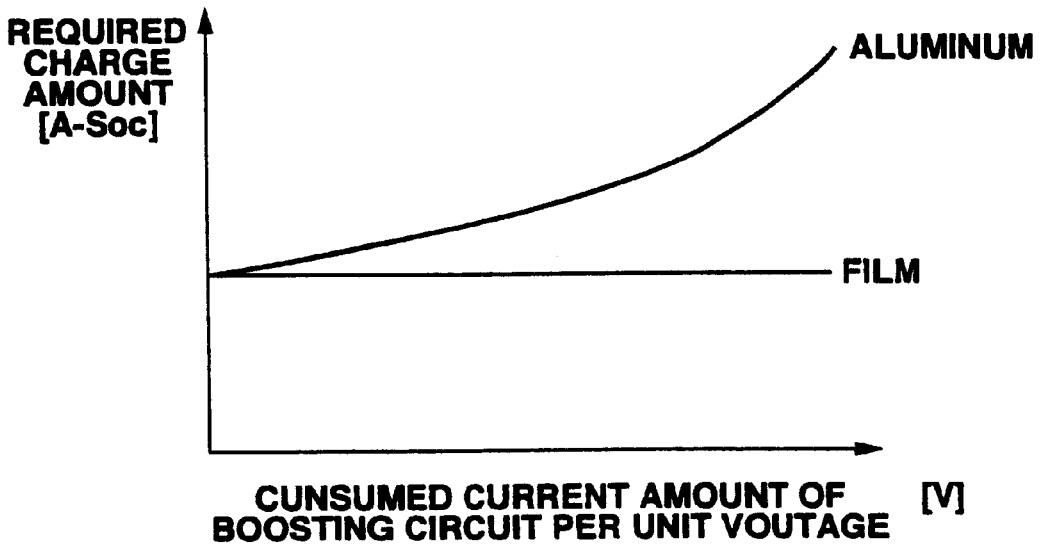
FIG.11 PRIOR ART
FIG. 11 is a diagram showing the consumed current amount of a boosting circuit necessary for boosting a unit voltage of a typical aluminum electrolytic capacitor and a film capacitor.
Figure 12:
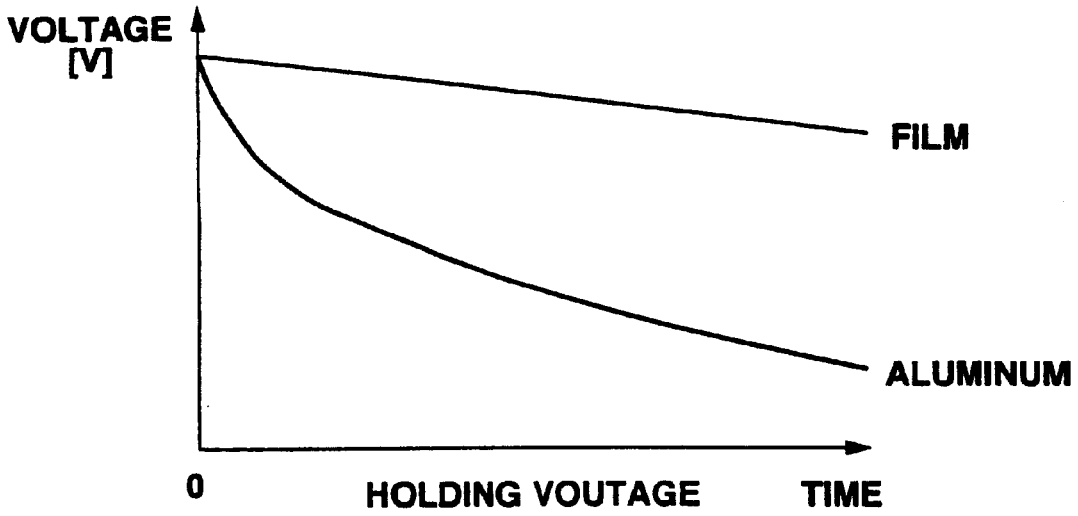
FIG.12 PRIOR ART
FIG. 12 is a diagram showing the lapse of time of the holding voltage of a typical aluminum electrolytic capacitor and a film capacitor.

Here, the strobe light emission is explained in conjunction with FIG. 9. FIG. 9 is a flow chart which shows the light emission subroutine (step S606) in the camera of this embodiment.

First of all, in a step S701, based on the luminance of the object measured by the light amount measuring means 6, the control means 1 calls data which converts the necessary strobe light amount into the light emission time and sets the strobe light emission time. Thereafter, in a step S702, the control means 1 outputs the light emission signal (H) from the STON terminal. Further, in the step S703, the control means 1 waits until the time set in the step S701 lapses and when the set time has lapsed, the control means 1 advances to a step S704.

In the step S704, to stop the light emission, the control means 1 outputs the OFF signal from the STON terminal so as to end the light emission. Thereafter, the control means 1 sets the light emission flag (H) which indicates that the strobe light emission was performed in the step S705 and ends the light emission subroutine.

Upon completion of the light emission subroutine, the control means 1 returns to the subroutine ⌈2R⌋ shown in FIG. 8 and closes the shutter in the step S607 so as to end the exposure to the film and executes the sub routine for performing the strobe charging (see FIG. 5) in a step S608.

In this strobe charging, the control means 1 advances in the [Y] direction in the step S301 shown in FIG. 5 which means the charging after the light emission, the charging is performed in all cases. Then, when the charging ends, the control means 1 winds one frame to of the film and ends the subroutine [2R].

As has been explained heretofore, according to the camera of this embodiment, the charging after the strobe light emission is performed unconditionally, while with respect to the charging in other occasions, the judgment of charging is performed based on the time lapse flag and hence, even when the turning on and off of the photographing preparation switch 1R is repeated many times, the charge voltage of the capacitor is not increased to a level that the charge voltage exceeds the full charge voltage so that the wasteful consumption of the energy can be eliminated.

Further, the setting of time is performed to match the condition of the capacitor. That is, when the temperature of the camera per se or the ambient temperature is high, the voltage of the capacitor is liable to be reduced and hence, the set time of the time lapse flag is made short, while when the temperature of the camera per se or the ambient temperature is low, the set time of the time lapse flag is made long.

Further, by storing the light emitting energy in the film capacitor, the flash light emission with improved efficiency can be realized.

Although the strobe light emission has been explained with respect to the irradiation of light to the object at the time of photographing in this embodiment, no problem occurs even when the light emission flag is set in the charging after completion of the light emission with respect to the preparatory irradiation for the light amount measurement and the distance measurement.

As explained in detail heretofore, according to the embodiment of the present invention, the following constitution can be obtained. That is:

(1) In a flash light emitting device which includes a charging circuit for charging light emitting energy to a capacitor by boosting a power supply voltage, a voltage detection circuit which measures the charge voltage of the capacitor, a light emitting circuit which makes a flash light emitting tube emit light due to the energy of the capacitor, and timer means which counts time from the completion of the charging, the improvement is characterized in that the flash light emitting device further includes charging control means which allows the charging operation by the charging circuit when the time counted by the timer means becomes equal to or more than a given time and prohibits the charging operation when the time counted by the timer means has not yet reached the given time.

(2) In the flash light emitting device described in the above-mentioned (1), when the light emitting operation by the above-mentioned light emitting circuit is performed, the recharging operation is compulsorily performed after the light emitting operation irrespective of the above-mentioned counted time.

(3) In the flash light emitting device described in the above-mentioned (1) or (2), the capacitor is a film capacitor.

(4) In a flash light emitting device of a camera which includes a charging circuit for charging light emitting energy to a capacitor by boosting a power supply voltage and a light emitting circuit which makes a flash light emitting tube emit light due to the energy of the capacitor, the improvement is characterized in that the flash light emitting device further includes timer means which counts time from the completion of the charging by the charging circuit, counted time judging means which compares the time counted by the timer means with a given time, and charging control means which performs a judgement control on whether a next recharging operation start by the charging circuit is to be allowed or not based on the result of the counted time judging means at the time of inputting of a manipulation switch which sets a camera in a photographing preparation condition.

(5) In the flash light emitting device described in the above-mentioned (4), when the light emitting operation by the light emitting circuit is performed, the recharging by the charging circuit is allowed after the light emitting operation irrespective of the result of the counted time judging means.

(6) In the flash light emitting device described in the above-mentioned (1) or (4), the given time is changed and set depending on the ambient temperature condition.

(7) In the flash light emitting device described in the above-mentioned (6), the set value of the given time when the temperature is high is made shorter than the set value of the given time when the temperature is low and then is stored.

(8) In the flash light emitting device described in the above-mentioned (1) or (4), the given time is set based on time in which the charge voltage of the capacitor is lowered by natural discharge from the full charge voltage level for performing the normal light emission to the minimum light emission voltage level which allows emission.

In the present invention, it is apparent that working modes different in a wide range can be formed on the basis of the present invention without departing from the spirit and the scope of the invention. The present invention is not restricted by any specific embodiments except being limited by the appended claims.

What is claimed is:

1. A flash light emitting device comprising:

a capacitor;

a flash light emitting tube;

a charging circuit for charging light emitting energy into the capacitor by boosting a power supply voltage;

a light emitting circuit for causing the flash light emitting tube to emit light using the light emitting energy of the capacitor;

charging completion means for stopping charging of the capacitor when the charging circuit has performed a predetermined amount of charging to the capacitor;

timer means for counting a lapsed time from a point of time that charging is stopped by the charging completion means; and charging control means for controlling charging such that until the lapsed time counted by the timer means reaches a predetermined value, recharging of the capacitor by the charging circuit is prohibited except for when a light emitting operation of the flash light emitting tube is started by the light emitting circuit when the recharging of the capacitor by the charging circuit is performed immediately after light emitting irrespective of the lapsed time counted by the timer means.

2. A flash light emitting device according to claim 1, wherein the predetermined value of the lapsed time is changeable to correspond to an ambient environmental condition.

3. A flash light emitting device according to claim 1, wherein the capacitor is a film capacitor which has higher dielectric insulation resistance than an aluminum electrolytic capacitor.

4. A flash light emitting device according to claim 1, wherein the predetermined value of the lapsed time is set using a time which corresponds to a lowering of a voltage of the capacitor caused by natural discharging from a full charge voltage level which assures a normal full light emission to a minimum light emitting voltage level.

5. A flash light emitting device comprising:

a capacitor;

a flash light emitting tube;

a charging circuit for charging light emitting energy into the capacitor by boosting a power supply voltage;

a light emitting circuit for causing the flash light emitting tube to emit light using the light emitting energy of the capacitor;

charging completion means for stopping charging of the capacitor when the charging circuit has performed a predetermined amount of charging to the capacitor;

timer means for counting a lapsed time from a point of time that charging is stopped by the charging completion means;

signal generating manipulation means for outputting a start signal to start charging of the capacitor in response to a given manual manipulation; and charging control means for enabling the charging circuit to perform a charging operation responsive to the start signal when the lapsed time counted by the timer means becomes equal to or greater than a predetermined value, and for prohibiting the charging circuit from performing the charging operation when the lapsed time counted by the timer means is less than the predetermined value.

6. A flash light emitting device according to claim 5, wherein the charging circuit performs a brief charging into the capacitor responsive to the start signal when the lapsed time counted by the timer means becomes equal to or greater than a predetermined value, to thereby measure a current charge voltage of the capacitor.

7. A flash light emitting device according to claim 5, wherein when a light emitting operation of the flash light emitting tube is performed by the light emitting circuit, the charging control means controls charging so as to compulsorily start a recharging operation of the capacitor immediately after light emitting irrespective of the lapsed time counted by the timer means.

8. A flash light emitting device according to claim 5, wherein the capacitor is a film capacitor which has higher dielectric insulation resistance than an aluminum electrolytic capacitor.

9. A flesh light emitting device according to claim 5, wherein the predetermined value of the lapsed time is changeable to correspond to an ambient environmental condition.

10. A flash light emitting device comprising:

a capacitor;

a flash light emitting tube;

a charging circuit for charging light emitting energy into the capacitor by boosting a power supply voltage;

a light emitting circuit for causing the flash light emitting tube to emit light using the light emitting energy of the capacitor;

charging completion means for stopping charging of the capacitor when the charging circuit has performed a predetermined amount of charging to the capacitor;

timer means for counting a lapsed time from a point of time that charging is stopped by the charging completion means;

signal generating manipulation means for outputting a start signal to start charging of the capacitor when an input signal is input by a manipulation switch which sets a camera in a photographing preparation condition; and charging control means for enabling the charging circuit to perform a charging operation responsive to the start signal when the lapsed time counted by the timer means becomes equal to or greater than a predetermined value, and for prohibiting the charging circuit from performing the charging operation when the lapsed time counted by the timer means is less than the predetermined value.

11. A flash light emitting device according to claim 10, wherein the charging circuit performs a brief charging into the capacitor responsive to the start signal when the lapsed time counted by the timer means becomes equal to or greater than a predetermined value, to thereby measure a current charge voltage of the capacitor.

12. A flash light emitting device according to claim 10, wherein when a light emitting operation of the flash light emitting tube is performed by the light emitting circuit, the charging control means controls charging so as to compulsorily start a recharging operation of the capacitor immediately after light emitting irrespective of the lapsed time counted by the timer means.

13. A flashlight emitting device according to claim 10, wherein the predetermined value of the lapsed time is changeable to correspond to an ambient environmental condition.

14. A flash light emitting device according to claim 13, wherein the predetermined value of the lapsed time is set to a shorter time when an ambient temperature is high as compared to when the ambient temperature is low.

* * * * *